United States Patent [19]

Fritz et al.

[11] Patent Number: 4,655,437

[45] Date of Patent: Apr. 7, 1987

[54] APPARATUS FOR SIMULTANEOUSLY SEPARATING VOLATILE AND NON-VOLATILE METALS

[75] Inventors: Leonard Fritz, Romulus; Richard R. Osterberg, Canton; Richard B. Wolanski, Dexter; Joseph E. Arvay, Trenton, all of Mich.

[73] Assignees: Huron Valley Steel Corp., Belleville; Fritz Enterprises, Inc., Taylor, both of Mich.

[21] Appl. No.: 825,255

[22] Filed: Feb. 3, 1986

Related U.S. Application Data

[62] Division of Ser. No. 729,994, May 3, 1985.

[51] Int. Cl.[4] ..... C22B 4/00

[52] U.S. Cl. ..... 266/197; 75/10.19

[58] Field of Search ..... 266/197; 75/10.19

[56] References Cited

U.S. PATENT DOCUMENTS 3,429,691 2/1969 McLaughlin ..... 75/10.19

3,843,351 10/1974 Smith ..... 75/10.19

4,466,824 8/1984 Gauvin ..... 75/10.19

*Primary Examiner*—Peter D. Rosenberg

*Attorney, Agent, or Firm*—Cullen, Sloman, Cantor, Grauer, Scott and Rutherford

[57] ABSTRACT

A method and apparatus for simultaneously separating volatile metals, including zinc and lead, and non-volatile metals, including copper, from mixtures of metallic and metallic oxide. Finely pulverized metal containing material, is continuously fed into the reactor chamber along with pulverized carbonaceous material, such as coke, and also oxygen or air. The reactor chamber is intensely heated by a transferred arc plasma generator to provide sufficient heat energy which together with the reducing gases cause a reducing reaction and melt the non-volatile copper and other metals which form a puddle upon the floor of the reaction chamber and to form a layer of slag covering the puddle, and simultaneously to vaporize the volatile zinc, lead and the like metals.

8 Claims, 2 Drawing Figures

APPARATUS FOR SIMULTANEOUSLY SEPARATING VOLATILE AND NON-VOLATILE METALS

This is a divisional of my co-pending application, Ser. No. 729,994, filed May 3, 1985.

BACKGROUND OF INVENTION

In the manufacture of commercially used zinc, copper, brass and steel, waste by-products result which include mixtures of metal and metal oxides and other non-metallic ingredients. Such waste by-products are sometimes in the form of drosses, skims and ash produced in the melting and refining of metals. In whatever form, such waste by-products frequently are considered an environmental hazard and require special disposal because many are leachable and can enter ground water systems. Thus, these common waste products frequently cannot be simply dumped for disposal purposes.

In addition, these waste products commonly include metal which have commercial value provided they can be separated economically. Various kinds of separation processes have been developed to recover metal from waste by-products but these generally require multi-step processing that are relatively expensive considering the value of the recovered metals.

In addition, the recovery of zinc from low grade zinc ores, which, after roasting and calcination, basically comprise quantities of zinc oxides, require a high percentage of zinc bearing material for economical recovery of zinc from the ores. These ores would normally require a significant amount of concentrating steps to upgrade the zinc content sufficiently to make recovery of the zinc economically feasible. Complex zinc ores such as zinc silicates and zinc-iron complexes provide even more difficulty in recovery and are therefore usually rejected as suitable zinc ores for conventional practices. Such ores could be used as feed stock for this invention with only minimal preparation.

Hence, the invention herein is concerned with providing an economical, relatively simple process and apparatus for recovering and separating certain metals, particularly zinc and copper, from waste by-products, low grade and certain complex zinc ores which do not respond to standard recovery practices, and the like materials which are normally considered of little value and simultaneously converting what would otherwise be a toxic or hazardous material into non-toxic and commercially useable residue.

SUMMARY OF INVENTION

The invention herein is particularly useful in producing simultaneously a commercial grade zinc product, commercially useful grades of copper alloys and a non-toxic, commercially useable slag residue. The apparatus includes a vertically arranged stack or shaft connected at its lower end to an enlarged reaction chamber and at its upper end to an enlarged reflux chamber. Pulverized mixtures of metallic and metallic oxide and the like material with coke or other suitable carbonaceous material and oxygen or air is continuously fed into the lower reaction chamber. There, the material is subjected to the intense heat of a transferred arc plasma generator which produces a plasma arc as well as heat caused by electron flow between the plasma torch and an anode. This intense heat along with the reducing gases formed from the injected pulverized carbon and air is responsible for a reduction reaction that takes place and simultaneously melts the non-volatile materials, such as copper, iron, precious metals, etc. and vaporizes the volatile metals, such as zinc and lead.

The melted metals gravity flow to the floor of the lower reaction chamber to provide a puddle or pool of molten metal. The slag produced in the reaction chamber chamber forms a layer over the puddle. Meanwhile, the volatile metal vapors rise upwardly through the vertical stack or shaft into the reflux or condensation chamber.

The shaft is filled with a mixture of pieces of metallic materials, having minimal or no oxides, mixed with carbon materials, such as coke, so that the vapors are subjected to a reduction reaction and also a scrubbing effect as they pass through the filling in the stack.

The filling of the stack is accomplished by dropping charges of the material forming the filling into the top of the reflux chamber where it drops downwardly into the upper end of the stack or shaft. The reflux chamber is normally sealed to prevent the escape of pressure or the influx of air. The periodic passage of the batches of material through the reflux chamber into the upper end of the shaft, absorbs heat that rises upwardly through the shaft, to control the temperature range within the reflux chamber. The pressure within the reflux chamber is also controlled within a range.

By maintaining the heat and pressure of the reflux chamber within a prescribed range that will condense lead, but not condense zinc, the lead vapors coalesce around lead nuclei in the chamber to condense and form drops that pass downwardly back through the stack and into the puddle in the reaction chamber. The downward passage of the lead droplets pick up free lead rising upwardly due to being carried by the upwardly moving vapors.

The zinc vapor, as well as other metallic vapors, such as cadmium and possibly some small amount of lead vapors which have not condensed, are removed from the upper chamber through exit ducts which may be cooled along their lengths to reduce the vapor temperatures. The vapors then flow into a conventional condenser at just above condensation temperature. There the vapors are condensed into a useable, commercial grade zinc containing small amounts of lead, cadmium, and the like. This can result in producing prime western zinc or a similar commercial grade zinc which can be used directly as a product or can be further processed to increase the purity of the zinc or to recover other metals contained therein.

By appropriately controlling the amount of copper bearing materials charged into the reactor, either through the pulverized charge into the lower reactor or by inclusion in the metallic batch material charged into the upper end of the reactor, a commercial grade copper alloy can be produced in the puddle or pool in the lower reactor chamber. The puddle can be tapped periodically to remove molten metal which can then be used either as a commercial grade material or alternatively, further refined or alloyed. Likewise, since precious metals are non-volatile and will flow into the puddle, these can be separately recovered by known processes.

The slag which forms during the reaction is non-toxic and thus, can be tapped off and solidified and used as an aggregate or other filling material or it can be dumped without special storage requirements such as are required in handling and disposing of hazardous waste.

The process contemplates the use of very high temperature, that is, the intense heat energy provided by a plasma torch, supplemented by the heat energy resulting from chemical reactions and electron flow. For that purpose, one or more plasma torches may be used within the reaction chamber and one or more anodes are positioned in the floor of the chamber so that the anode is covered by the copper puddle. Thus, electron flow is through the molten copper which, has relatively low resistance to the passage of the electrons and assists in the production of heat energy by the electron flow. Thus, this type of plasma generator used in the manner described produces heat with very high efficiency. That intense heat in a totally reducing atmosphere is utilized to cause the reduction, melting and vaporization steps simultaneously.

The process of this invention also can handle other metal composition forms, such as metal chlorides, etc., beyond the metal oxides mentioned. Further, it is contemplated that the process can be used to process low grade zinc ores which may have 40% or less of zinc, particularly in zinc silicates and other complex forms.

A further object of this invention is to provide a process for converting waste metallic by-products, which may be in the form of dust or fine particles, by utilizing material in that form to provide the continuous charge into the lower reactor where it is subjected to the heat produced by the plasma generator.

Another objective of the invention is to provide an economical alternative to the storage or dumping of toxic wastes containing useful metals such as lead and zinc and to provide a means for recovering zinc, lead, copper and the like from oxidized metal by-products resulting from various zinc, copper and brass manufacturing procedures.

Yet a further object of this invention is to provide for the vertically upward movement of the vapors of the volatile metals so that the lead vapors may expand and condense within the upper reflux chamber and the condensed lead may then rain downwardly through the carbon filled stack. This simplifies and shortens the flow path of the vapors and the condensation. Further, because of the passage through the carbon filled stack, additional reduction and some scrubbing is provided.

These and other objects and advantages of this invention will become apparent upon reading the following description, of which the attached drawings form a part.

DETAILED DESCRIPTION

Figure 1:
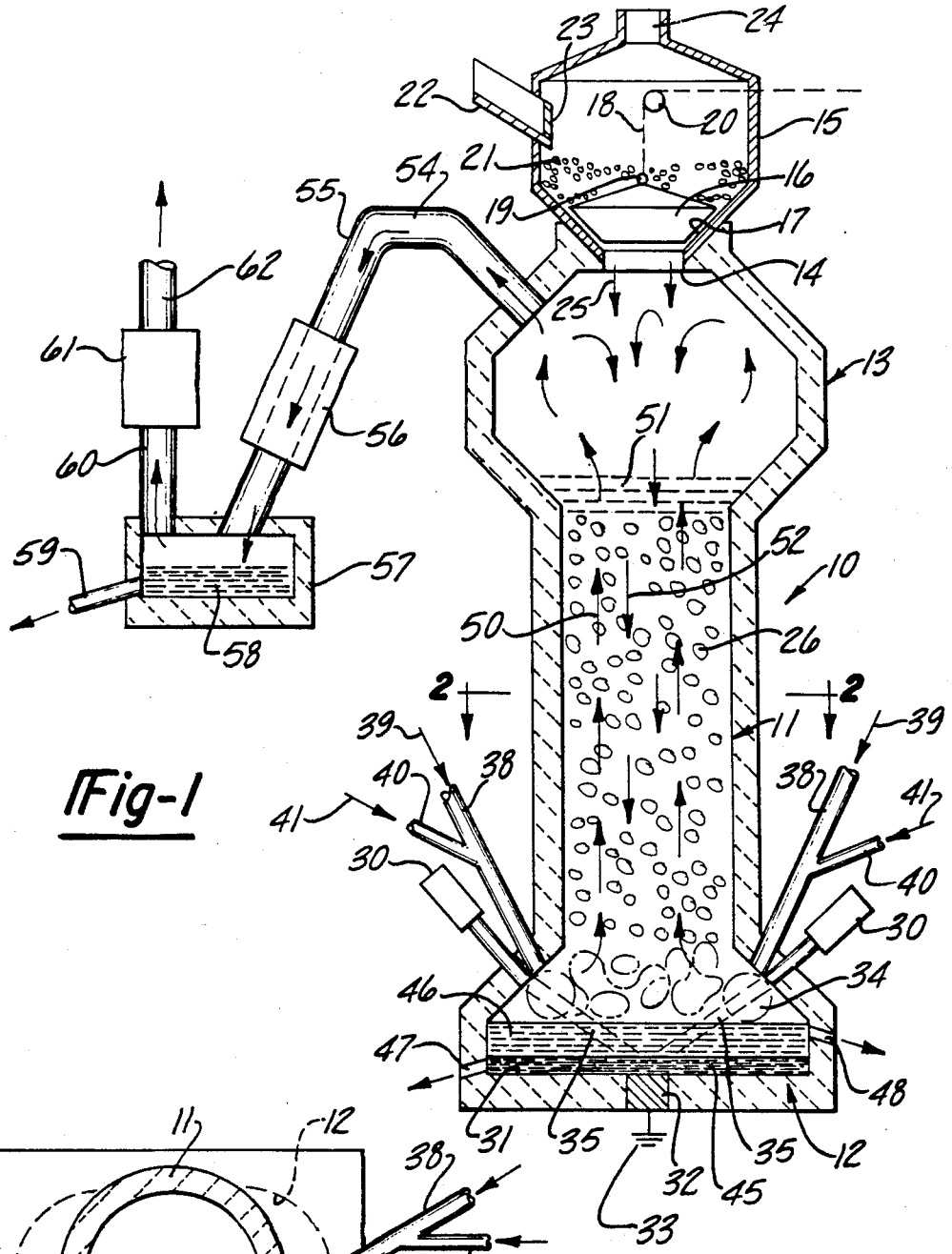
FIG. 1 is a cross-sectional, schematic view of the reactor and the external condenser equipment.

The reactor 10 has a vertically arranged, central shaft or stack 11 whose lower end opens into a lower, reaction chamber 12. The upper end of the shaft opens into an upper, reflux chamber 13.

The upper chamber 14 has a top feed opening 14 above which a feed hopper 15 is positioned. This hopper includes an inverted bell or truncated conical closure 16 fitted within and sealed against a seat 17. The closure may be lifted for opening relative to the seat by a suitable lift mechanism which is schematically shown as a lift cable 18 connected to a ring 19 on the closure and passing around a pulley 20 located near the top of the hopper. The cable passes outside of the hopper for connection to a suitable motor for applying the force for lifting the closure.

The hopper is filled with charge material 21 which is placed into the hopper through a chute 22 that is normally closed off by a closure 23. A suitable gas exhaust stack 24 is located at the upper end of the stack.

As indicated by the arrows 25, when the closure 16 is lifted, an annular or donut-shaped charge drops through the upper, condensation chamber feed opening 14. The charge gravity falls through the chamber and into the open, upper end of the shaft 11. Thus, the shaft is filled with a filling material 26 by top charging it periodically. Such filling material is composed of pieces of metallic materials, such as zinc, copper and other materials and coke or some other equivalent carbonaceous material.

Figure 2:
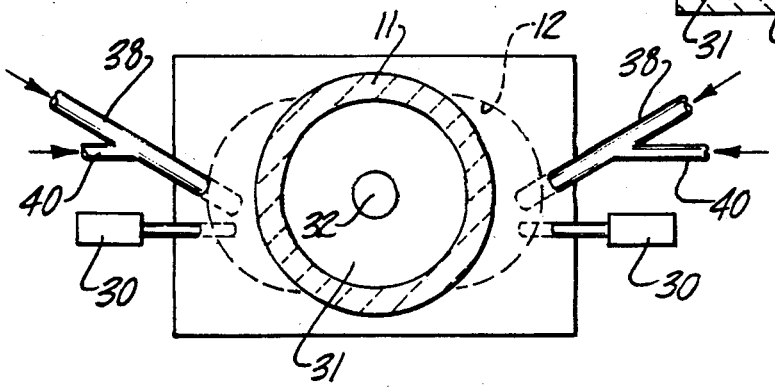
FIG. 2 is a schematic, cross-sectional view taken in the direction of arrows 2—2 of FIG. 1.

The lower reaction chamber 12 is provided with intensive, concentrated heat by means of one or more transferred arc plasma generators having torches 30 extending through the wall of, but flush with the inside wall surface of, the reaction chamber. The drawings schematically illustrate the use of two such torches, but it may be preferable to use more, depending upon the size and throughput of the equipment. As can be seen in FIG. 2, it is preferable to form the reaction chamber as an elongated, oval shape, although it may be round, similar to the shaft.

The reaction chamber floor 31 is preferably provided with a central anode 32 that is grounded at 33. Thus, the plasma torch produces its plasma cloud or envelope 34 which provides a concentrated, intense heat, such as on the order of 12,000 to 15,000 degrees F. In addition, the transferred arc plasma generator is characterized by also producing an electron flow 35 which, in this case, will travel to the central anode, and which produces heat in addition to the plasma heat. The electron flow, indicated by the dotted lines 35 in FIG. 1, passes through the reaction chamber to produce a temperature of roughly 2950 degrees F. therein.

The plasma torch is a commercially available item. An example of a suitable torch is a 2-3 Megawatt plasma torch manufactured by Plasma Energy Corporation, Raleigh, N.C. Other commercially available units can be obtained. This type of torch, although not in the same detail as the commercially available torches, is generally disclosed in patents, such as in U.S. Pat. No. 3,673,375 issued June 27, 1972 to Camacho and U.S. Pat. No. 3,818,174 issued June 18, 1974 to Camacho, each of these patents disclosing a "long arc column forming plasma generator".

The reaction chamber 12 is charged continuously with a pulverized mixture of metallic oxides, metals and coke or other equivalent carbonaceous material. Such material may be obtained in fine, dust-like form as a waste by-product, such as from the waste of steel producing processes by means of electric arc furnaces. It may also be in the form of small particles, such as in the range of 100 mesh or less produced as by-products of zinc or copper or brass or the like manufacturing processes wherein such waste may be captured by filtering exhaust gases. Alternatively, the material may be in larger pieces which requires crushing or pulverizing before use in the presently disclosed process. Where pulverization is required, conventional pulverizers or crushers may be used. The particular size of the pulverized material is not critical although it is preferable to have it below 100 mesh.

The charge is inserted in the reaction chamber through a feed tube 38, as indicated by the arrow 39 signifying, schematically, the charge material. In addition, air or oxygen, from a suitable blower or oxygen supply source, is fed through a tube 40, as indicated by the arrow 41, into the feed tube 38 for entry into the reaction chamber.

A small amount of water, such as in the range of less than 5%, may also be added where the material fed in is dry.

In the reaction chamber, the intense heat causes a reducing reaction to take place which reduces the oxides. The heat also disassociates the water, where water is used or is present as moisture, to provide hydrogen and carbon monoxide for furtherance of the reducing reactions.

Simultaneously, the non-volatile metals which are inserted through the continuously fed pulverized charge in the reaction chamber, as well as from the materials which are top fed into the shaft and which work their way down to the reaction chamber, are melted and form a puddle or bath or pool 45 on the floor 31 of the reaction chamber 12. Such non-volatile metals include copper, iron, tin, precious metals such as gold, silver or platinum, and the like. Since this process is particularly adapted to producing a commercially useable copper alloy or brass, it is preferable to feed a sufficient quantity of copper into the system so that the puddle is predominantly formed of copper with the other non-volatile metals acting as either impurities or additives. In the case of impurities, such as precious metals, further processing of the puddle can be done elsewhere to recover these. In the case of additive use, the copper alloy can be used as a commercial grade copper or brass.

In addition, the reaction chamber produces a molten slag layer 46 upon the puddle, which protects the puddle once the molten material reaches it. Preferably, the slag is of a nature to repel zinc so that zinc is not carried into the slag or the puddle.

The volatile metals, such as zinc, lead and cadmium, which either begin in metallic form or become available by reduction, vaporize. As mentioned, the slag has a tendency to repel zinc oxides and keep them from entering into the slag. For example, iron oxide and ferric oxide in the slag will tend to repel the zinc oxide.

The reaction chamber is provided with a conventional tap or normally closed opening 47 for tapping the puddle of molten metal periodically. Likewise, a slag opening or tap 48 is provided for tapping the slag either continuously or periodically, as appropriate.

Meanwhile, the rising vapors (schematically shown by arrows 50) of the volatile metals, flow upwardly through the filling 26 in the shaft 11 and enter the upper, reflux chamber 13. These vapors, which include heavy lead vapors expand and are reduced in temperature in the enlarged reflux chamber. However, some of the heavy lead vapors form a cover or cloud 51 over the top of the open shaft that thereby covers the filling and acts as a filter.

The temperature and pressure within the upper, reflux chamber is regulated within a range which is sufficient to cause the lead vapors to condense and coalesce into metallic lead droplets which, like rain, drop downwardly into the shaft. However, the temperature and pressure combination is maintained at a level which is insufficient to condense zinc. Thus, as indicated by the arrows 52, the condensed lead falls down while the zinc vapors, indicated generally by arrows 54, flow upwardly and out through one or more ducts 55. These ducts are cooled by pre-condenser coolers 56 (shown schematically), which can, for example, comprise water cooling coils. The zinc vapors are cooled almost to the point of condensation and then enter into a conventional condenser 57, such as of the splash type condensers. There, the zinc condenses into a bath 58 which can be periodically removed through a tap 59. The molten bath temperature in the condenser well is maintained at 1022 degrees F. (i.e., 550 degrees C.) by the insertion of water cooling coils into the condenser well.

A small amount of lead vapor or condensed lead may be carried with the zinc vapor, as well as other non-condensed vapors, such as cadmium and the like. When these condense to form the metallic zinc bath, the bath is pure enough to be useful as a commercial grade zinc. For example, it may form "prime western zinc", a commercial grade having over 98.5% zinc, with a small amount of lead, e.g., 0.5% and cadmium, etc.

Further, gases and uncondensed vapors, such as zinc chlorides, exhaust from the condenser through a gas exhaust duct 60 and are cooled by a suitable heat exchanger system 61 to a temperature slightly higher than the condensation temperature of zinc chloride where they are then passed via ductwork 62 into a conventional zinc chloride condenser where metal chlorides (primarily zinc) present in the gas stream are condensed and removed from the system. The remaining gases exhaust the chloride condenser and are further processed for subsequent use as fuel gas for preliminary drying of the feed materials or other uses. These gases are essentially carbon monoxide, hydrogen and nitrogen. The gas treating systems and chloride condensers are commercially obtainable equipments and therefore further details are omitted here.

In the operation, which is continuous in the reaction chamber, the rising vapors carry heat upwardly into the reflux chamber 13. The pressure in the shaft is maintained relatively low, such as at 4–5 PSI gauge to permit the upward flow of the heated vapors. The heat within the reflux chamber is regulated to a considerable extent by the quantity and timing of the charge dropped into the top of that chamber. That is, the charge is relatively cool so that it absorbs heat to thereby cool the chamber and prevent its overheating to the point where the lead cannot condense. Further, the chamber atmospheric pressure is maintained at its desired level by controlling the withdrawal of the zinc vapor to the condensers and by preventing the influx of air into the chamber or the uncontrolled exhaust of the pressurized vapors from the chamber by means of the type of closure and hopper used for periodically charging the material into the top of the chamber. Other types of seal functioning charge mechanism can be used so long as the influx of air and the exhaust of pressurized gases is minimized in order to maintain the operating pressure and temperature ranges required within the reflux chamber.

The metallic lead flowing back down the shaft tends to pick up lead that is carried upwardly by the vapors. In addition, the filling within the shaft, which is primarily formed of carbon, maintains a reducing atmosphere so that the rising vapors will not be allowed to reoxidize. The heat carried by the vapors and induced by the plasma torch along with the ascending reducing gases, provides for reduction reactions in the shaft.

While the size and throughput of the equipment can be varied, following known engineering procedures, an example of this equipment is as follows:

The shaft may be approximately 5 feet in internal diameter, 10–12 feet in height, and with the internal diameter of the upper chamber being about 10 feet in diameter. The overall height of the reactor is about 55 feet including the feed hopper on the top. The elliptical larger diameter of the lower reactor can be about 10–12 feet with the shorter diameter being about 5 feet.

The top charge should be fairly free of oxides, i.e., preferably less than 5% oxides, in order to prevent the formation of excessive carbon dioxide which results from the reduction of zinc oxide by carbon monoxide. Such carbon dioxide in sufficient quantity can reoxidize the ascending zinc vapors.

The equipment described above produces about 3 tons per hour of commercial grade zinc at the condenser, about 6 tons of slag per hour, and about one-half ton of copper alloy per hour. For this production, the top charge takes, roughly, 1,200 lbs. of zinc metal per hour and approximately 1,600 lbs. of coke per hour. The charge into the lower reactor is approximately 13,000 lbs. of metal oxides containing 40% or more of zinc and approximately 1,600 lbs. of fine particle carbon, such as coke, blown in with it. Preferably, a maximum of about 5% water is contained therein. 3,600 lbs. of air per hour is blown in to provide the requisite oxygen for the initial formation of reducing gases.

As mentioned above, the water breaks down into $H_2$ and O with the hydrogen serving as a reducing gas and the oxygen being picked up by the carbon to form carbon monoxide which is also utilized as a reducing medium. Thus, a small amount of water is desired for operation of the process.

The temperature in the reflux chamber is preferably maintained roughly in the range of 1800° F. where the lead condenses or coalesces, but the zinc does not. The pressure and temperature in the upper chamber is maintained at a point higher than the dewpoint of zinc, but within the range of the condensation of lead, in order to permit the zinc to continue to remain in vapor form.

The metallic vapors leave the shaft at roughly 1180° C. and the zinc vapor and gas exit the reflux chamber at roughly 1010° C. As the vapors and gas travel through the pre-condenser, the temperature is dropped to roughly 880° C. to enter the zinc splash condenser where the vapor and gas is sufficiently cooled to condense the zinc and to maintain the zinc at roughly 550° C. in the condenser by means of water cooled coils.

The gas from the condenser, which is formed during the reduction reactions, contains primarily carbon monoxide, nitrogen and hydrogen. Thus, by passing these through a chloride eliminator, a commercial piece of equipment, the small quantities of zinc chloride are condensed and removed and thus, the hydrogen and carbon monoxide can be utilized as a source of fuel for preliminary drying of the feed material and coke or for other uses as desired.

On a percentage calculated basis, an example of the operation is the feeding into the system zinc dross sludge (e.g., 40% zinc, 30% $SiO_2$, 1% chlorides), electric arc furnace dust (e.g., 18% zinc, 38% CaO, 26% FeO), millscale (70% Fe) and ground coke (85–90% C dried and sized to −3 MM). The resultant product will be a zinc metal containing some lead (e.g., 0.3–0.5 Pb), a copper-lead alloy, and a non-toxic slag (e.g., containing $SiO_2$-50%, FeO-20% and CaO-30%).

The energy requirement is about 0.75 KWH per pound of zinc produced. The carbon requirement is about 0.54 lbs. carbon per zinc produced and the slag produced runs about 1 lb. of slag per pound of zinc produced. The air requirement is about 0.49 lbs. of air per pound of zinc produced.

Having described an embodiment of this invention, we now claim:

1. A reactor for simultaneously separating volatile metals, including zinc and lead, and non-volatile metals, including copper, from material containing such metals or metal oxides comprising:

an open-ended, generally vertical shaft having its lower end opening into the top of an enlarged reaction chamber having a floor, and its upper end opening into the bottom of an enlarged, closed upper chamber;

a transferred arc plasma generator arranged within the reaction chamber to produce a plasma arc and a heat producing electron flow;

means for feeding a finely pulverized mixture of metals, which may be in the form of metallic oxides, containing zinc, lead and copper, and carbonaceous material, into the plasma generator heated reaction chamber along with oxygen containing gas for producing a reduction reaction, and wherein the non-volatile metal melts and forms a molten puddle upon the floor and a molten layer of slag is formed upon the puddle, and the volatile metal vaporizes and the vapors flow upwardly through the shaft and into the upper chamber;

means for substantially filling the shaft with a mixture of pieces of metallic bearing materials and of carbonaceous material so that the vapors rise upwardly through the filling;

the upper chamber being heated by the heat energy rising from the reaction chamber and being maintained at a temperature and pressure range sufficient to cause condensation of the lead vapors, but insufficient to condense the zinc vapors, wherein molten lead is condensed in the upper chamber and gravity feeds back down through the shaft and shaft filling to the puddle;

and a duct connected to the upper chamber and to a condenser located outside of the reactor for receiving uncondensed vapors from the upper chamber and condensing such vapors into molten metal;

and the lower chamber having taps for periodically removing metal from the puddle and slag from the slag layer.

2. A reactor as defined in claim 1, and said means for filling the shaft comprising a hopper located above an opening into the top of the upper chamber and a closure normally closing said opening, but being selectively openable to drop filling material from the hopper into the top of the chamber and therefore, into the open upper end of the shaft, with said closure being formed to prevent any substantial loss of pressure from or influx of air into the upper chamber when the closure is opened to drop filling into the upper chamber.

3. A reactor as defined in claim 2, and said closure being formed in the shape of a downwardly and inwardly tapering plug and being closely fitted in a correspondingly shaped annular seat formed in the hopper to define the hopper opening for sealing the opening and for permitting an annular shaped charge of filling to flow into the upper chamber when the plug is raised into open position, and to thereby block the escape of pressurized vapor from the upper chamber or the influx of air into the upper chamber.

4. A reactor as defined in claim 1, and said plasma generator including at least one plasma torch entering into a side portion of the reaction chamber, and an anode located remotely from the torch and within the floor of the reactor chamber for providing a heat producing electron flow through the molten puddle located on the floor.

5. A reactor for simultaneously separating volatile metals, including zinc and lead, and non-volatile metals, including copper, from material containing such metals comprising:

an open-ended, generally vertical shaft having its lower end opening into the top of an enlarged reaction chamber having a floor, and its upper end opening into the bottom of an enlarged, closed upper chamber, said upper chamber having a cross-sectional area greater than that of the shaft and having a height sufficient to produce reflux action of vapors flowing upwardly through the shaft and into the upper chamber a transferred arc plasma generator arranged within the reaction chamber to produce a plasma arc and a heat producing electron flow;

means for feeding a finely pulverized mixture of metals, which may be in the form of metallic oxides, containing zinc, lead and copper, and carbonaceous material into the plasma generator heated reaction chamber along with oxygen containing gas for producing a reduction reaction, and wherein the non-volatile metal melts and forms a molten puddle upon the floor and a molten layer of slag is formed upon the puddle, and the volatile metal vaporizes and the vapors flow upwardly through the shaft and into the upper chamber;

means for substantially filling the shaft with a mixture of pieces of metallic bearing materials and of carbonaceous material so that the vapors rise upwardly through the filling;

the upper chamber being heated by the heat energy rising from the reaction chamber and being maintained at a temperature and pressure range sufficient to cause condensation of the lead vapors, but insufficient to condense the zinc vapors, wherein molten lead is condensed in the upper chamber and gravity feeds back down through the shaft and shaft filling to the puddle;

and a duct connected to the upper chamber and to a condenser located outside of the reactor for receiving uncondensed vapors from the upper chamber and condensing such vapors into molten metal;

and the lower chamber having taps for periodically removing metal from the puddle and slag from the slag layer.

6. A reactor for simultaneously separating volatile metals and nonvolatile metals, from material containing such metals comprising:

an open-ended, generally vertical shaft having its lower end opening into the top of an enlarged reaction chamber having a floor, and its upper end opening into the bottom of an enlarged, closed upper chamber, said upper chamber having a cross-sectional area greater than that of the shaft and having a height sufficient to produce reflux action of vapors flowing upwardly through the shaft and into the upper chamber;

an anode disposed in the floor of the reaction chamber;

a transferred arc plasma generator arranged within the reaction chamber to produce a plasma arc and a heat producing electron flow between said arc plasma generator and said anode;

means for feeding a finely pulverized mixture of volatile metals and non-volatile metals and carbonaceous material into the plasma generator heated reaction chamber along with oxygen containing gas for producing a reduction reaction, and wherein the non-volatile metal melts and forms a molten puddle upon the floor and a molten layer of slag is formed upon the puddle, and the volatile metal vaporizes and the vapors flow upwardly through the shaft and into the upper chamber;

means for substantially filling the shaft with carbonaceous material forming a reduction zone with the shaft so that the vapors rise upwardly through the filling without oxidation thereof;

the upper chamber being heated by the heat energy rising from the reaction chamber and being maintained at a temperature and pressure range sufficient to cause condensation of a first portion of said vapors, but insufficient to condense a second portion of said vapors, wherein said first portion is condensed in the upper chamber and gravity feeds back down through the shaft and filling to the puddle;

and a duct connected to the upper chamber and to a condenser located outside of the reactor for receiving said second portion of said vapors from the upper chamber and condensing said second portion of said vapors into molten metal;

and the lower chamber having taps for periodically removing metal from the puddle and slag from the slag layer.

7. A reactor as defined in claim 6, and said means for feeding a finely pulverized mixture comprising a feed tube opening into said reaction chamber adjacent said transferred arc plasma generator whereby said finely divided mixture of metals and carbonaceous material is subjected to the intense heat of said transferred arc plasma generator.

8. A reactor as defined in claim 6, and said plasma generator including at least one plasma torch disposed in a side portion of the reaction chamber for providing a plasma arc in the reaction chamber and a heat producing electron flow through the molten puddle.

* * * * *